United States Patent [19]

Marklund et al.

[11] Patent Number: 4,681,268

[45] Date of Patent: Jul. 21, 1987

[54] AUTOGENOUS GRINDING METHOD

[75] Inventors: Olle E. Marklund, Boliden; Carl-Gustaf Elmlid, Skellefteå; Ulf P. Marklund, Vilhelmina; Michael C. Borell, Skellefteå, all of Sweden

[73] Assignee: Boliden Aktiebolag, Stockholm, Sweden

[21] Appl. No.: 843,793

[22] PCT Filed: Nov. 22, 1982

[86] PCT No.: PCT/SE82/00392

§ 371 Date: Jul. 5, 1983

§ 102(e) Date: Jul. 5, 1983

[87] PCT Pub. No.: WO83/01914

PCT Pub. Date: Jun. 9, 1983

Related U.S. Application Data

[63] Continuation of Ser. No. 755,228, Jul. 15, 1985, abandoned, which is a continuation of Ser. No. 525,044, Jul. 5, 1983, abandoned.

[30] Foreign Application Priority Data

Nov. 27, 1981 [SE] Sweden ..... 8107096

[51] Int. Cl.[4] ..... B02C 23/08

[52] U.S. Cl. ..... 241/24; 241/29; 241/81

[58] Field of Search ..... 241/26, 29, 24, 30, 241/34, 284, 152 R, 81, 76, 77, 78

[56] References Cited

U.S. PATENT DOCUMENTS 3,773,268 11/1973 Bond ..... 241/284 X

FOREIGN PATENT DOCUMENTS 7909921 6/1983 Sweden .

*Primary Examiner*—Mark Rosenbaum

*Attorney, Agent, or Firm*—Brumbaugh, Graves, Donohue & Raymond

[57] ABSTRACT

The present invention relates to a method for comminuting a coarse lump mineral material in an autogenous grinding system, in which feed to the grinder is divided into a coarse fraction and a fine fraction. The coarse fraction is coarser than the inflection point on the coarse side of the knee of the particle size distribution curve of the charge of said autogenous grinder; the fine fraction is substantially all finer than the point of intersection between two tangents drawn between the adjacent inflection points on either side of the knee of the particle size distribution curve of the charge. The ratio between the amounts of fractions is determined on the basis of achieving a given charge quantity for a particular, selected set point power value for the mill in question, and determined with respect to a selected degree of grinding. Grinding efficiency is greatly increased by selecting feed sizes in accordance with the present invention.

6 Claims, 4 Drawing Figures

AUTOGENOUS GRINDING METHOD

This application is a continuation of application Ser. No. 755,228, filed 7/15/85, now abandoned, which is a continuation of application Ser. No. 525,044, filed on 7/5/83, now abandoned.

DESCRIPTION

1. Technical Field

The present invention relates to a method of comminuting lumps of homogenous and/or heterogenous mineral material in an autogenous primary grinding system, with the aid of screening, crushing and grinding apparatus, in which the lumps of mineral material are crushed to a given largest fragment size and then divided into a given coarse fraction, which forms the grinding mill charge of an autogenous primary grinding mill, and a given screened fragment size which is crushed to form a fine fraction.

The object of the present invention is to achieve maximum efficiency of comminution and minimum investment and operational costs in an integrated screeening, crushing and autogenous grinding system, in one or two stages. By mineral-material and material is meant here and in the following preferably ore minerals and industrial minerals.

2. Background Art

When processing a material, such as ore minerals and industrial minerals, in order to recover one or more of their valuable constituents, such as metal or industrial minerals, etc., the material is normally disintegrated mechanically in an initial sub-operation. The main object of this initial mechanical disintegration is to liberate the valuable constituents from the material prior to subjection it to a subsequent separation process, in which the valuable constituents contained in the material can be separated in dependence upon differences in colour, shape, and density, surface active properties, magnetic properties or other properties.

Normally, the material is primarily disintegrated mechanically to a certain extent when it is blasted from the rock or cleft face, and then subjected to a series of further comminuting operations, which may take different forms. In the past, further crushing of the of the material has normally been effected by crushing said material in a plurality of successive stages in jaw crushers and/or cone crushers, followed by fine grinding of the material in rotary drums containing grinding media such as balls or rods, normally made of steel. Because of the hardness of the rock, however, the grinding media are subjected to intense wear, with subsequent considerable costs.

In order to overcome this, there has been developed over the years a technique in which the material itself forms the grinding media, this technique being known as autogenous grinding.

The autogenous grinding technique has found wide use and is widely utilized the world over. Application of the autogenous grinding technique enables the extent to which the material is primarily crushed to be limited to a maximum lump size acceptable from the aspect of transportation. Consequently, the investment and operational costs of the crushers are relatively low. However, the absence of artificial grinding media having a high density in relation to the grinding mill charge, means that the specific grindability of the mill, expressed as grinding work/kWh energy consumed. Is decreased in comparison with commensurate mills in which grinding is effected with steel grinding media.

It is also known that the required power input of a drum mill when grinding, expressed in kW, is almost directly proportional to the density of the grinding mill charge media according to the relationship:

$$p = k \cdot \rho \cdot q \cdot n_c \cdot L \cdot D^{2.6},$$

where p = power in kW $\rho$ = density of the grinding mill charge = grinding media k = mill constant q = grinding charge, % by volume $$n_c = \text{relative mill speed} = \frac{\text{actual mill speed}}{\text{critical mill speed}}$$

L = mill length

D = mill diameter

It is axiomatic of the two latter factors (L,D) that the dimensions of the mill will be increased when the required power input increases, because of the increase in energy consumption, as compared with the case when grinding with high densities grinding media; from which it will be seen that these factors increase the investment and operational costs of the autogenous grinding system.

In an autogenous grinding system, in which the grinding charge media is formed from the coarser and stronger parts of the actual material to be ground, the composition of the grinding charge formed is totally dependent on the properties of the material. Experience has shown that mineral deposits are seldom homogenous with respect to their structure and mechanical strength. Consequently, the heterogenity of the material quite often causes the required input energy to vary, which in turn is largely due to a naturally formed, unsuitable particle-size distribution of the grinding mill charge. This is known to one skilled in the art as the "critical size" and it means on over-representation of certain particle-size fractions due to the inability of the material to create a satisfactory autogenous grinding mill charge.

It is also known to those skilled in this art that grinding of material in an autogenous grinding mill normally includes three comminuting mechanisms, namely:

1. Impact grinding, which is highly effective from the energy aspect.
2. Attrition grinding, in which smaller pieces of material are squeezed apart between larger grinding media agents. Attrition is economical with respect to energy consumption.
3. Abrasive grinding, which although requiring more energy than (1) and (2) is of great significance to the process. In abrasive grinding fines are rubbed from the surfaces of the grinding media.

When approaching the "critical size," the impact phase of the grinding process, according to (1), no longer functions, and this phase transfers to phase (3), thereby impairing the feed rate of a given mill. Thus, problems relating to "critical size" often require the grinding system to be excessively dimensioned, if a constant feed rate is to be maintained. Variations in the properties of the material to be ground also render it difficult to produce an autogenous grinding system of optimal design. Because of this, it often happens within the mining industry that autogenous grinding systems which have been especially planned and put into operation must later be converted to semi-autogenous grinding systems using steel balls as grinding charge media i.e. applying a semi-autogenous technique.

As will be seen from the mill-power formula above, when the feed rate of the material to be ground is constant, the power "p" and the charge volume "q" of the mill will change with varying grinding properties of the mill feed material i.e. there will be a change in the energy required in kWh/ton to effect grinding to a predetermined particle size distribution. It is known from the prior publication AU,B, 513,313 that the course taken by the grinding process is not only influenced by the physical properties of the material to be ground, but also by its mechanical composition, i.e. the particle size distribution of the feed.

DESCRIPTION OF THE PRESENT INVENTION

It has now been found possible to eliminate the great majority of the earlier disadvantages associated with autogenous grinding in primary mills, and also to provide the possibility of grinding material which has previously been considered unsuitable for autogenous grinding. According to the present invention, the material to be ground is crushed and screened into two fractions; a coarse fraction for forming the grinding mill charge, and a fine fraction comprising substantially the mill feed part, and is characterized by the fact that the largest lump size of the fine fraction is limited by and determined by an intersection point of the tangents through the points of inflexion situated on each side of the "knee" on the size distribution graph of the grinding mill charge of said material when autogenously grinding the material and that the smallest particle size of the coarse fraction exceeds the lump size represented by upper of said points of inflection; that feeding of the coarse and fine fractions is regulated in a manner such that (a) the amount of material charged to the mill is sufficient to maintain a given set-point value with regard to the required power input of the mill in question, or a given feed rate therethrough; and (b) the primary ground mill discharge has been ground to a preselected degree in dependence upon firstly the extent to which the respective fractions have been crushed and secondly the mass distribution between the coarse and fine fractions in the material charged to the mill.

In conjunction with the present invention, it has surprisingly been found that a plurality of process parameters essential to the autogenous grinding process can be pre-determined and controlled. By grading the material to be ground and the grinding media in a pre-determined fashion in accordance with the invention, the ground material leaving the autogenous grinding mill can be given a pre-determined particle size distribution, within wide limits, and the energy input, i.e. the grinding efficiency, can be considerable improved. Furthermore, in this way the magnitudes of energy requirement (kWh/ton, feed rate (tph), and particle-size distribution in the mill discharge, which normally varying greatly in conventional autogenous grinding processes, can be stabilized to a level which is extremely advantageous from the process aspect. With thought to the subsequent process steps of secondary grinding and separation processes, it is extremely desirable to maintain uniform feed rate and particle size distribution.

Prior to the final grinding stage, which is often necessary in order to enable the subsequent separation process to be carried out satisfactorily, The primary grinding stage is normally followed by a further, so-called secondary grinding stage. In autogenous grinding processes, the secondary grinding stage is performed in a pebble mill in which the grinding charge media comprises pebbles of suitable size fraction extracted from the primary mill. The material to be ground is given its final particle size distribution in the secondary grinding stage; this stage being considerably cheaper to carry out i.e. it can be effected to a higher grinding efficiency than the primary autogenous stage. Consequently, in order to achieve the lowest possible process costs it is important for the mill discharge of the primary autogenous grinding stage to obtain the coarsest possible particle-size distribution and, also to achieve a uniform feed rate.

The present invention enables an autogenous grinding system to be dimensioned and designed right from the planning and pilot stages, form optimal utilization of the advantages afforded by autogenous grinding and to obtain, in operation, a communiting process which is highly superior to conventional crushing-grinding systems from a technical and cost aspect.

In this respect the invention relates to a method comprising the pre-treatment of a material precrushed to a largest lump size, in which the material is screened to form three fractions, the coarsest fraction, possibly after being stored, being charged in the requisite amount to the mill as the grinding media and to form the grinding mill charge. The intermediate fraction of the aforesaid screened material is crushed to a given particle size in accordance with the invention, this particle size being referenced $K_{95}$ i.e. 95% by weight of the fraction is smaller than the given particle size, and is mixed together with the third, fine fraction of said screened material, said fine fraction being screened to the same given $K_{95}$ particle size as the intermediate fraction. The fine fraction may be stored before being used.

The resultant coarse and fine fractions respectively, are fed to the autogenous grinding mill in a fixed ratio, normally 10–25% of the coarse fraction and 90–75% of the fine fraction. The ratio between the fractions is dependent upon the largest size of the lump material to be ground before the pre-crushing operation, as well as the grinding properties of the material and pre-determined requirements with respect to the mill discharge, said ratio being determined empirically with respect to said factors.

In accordance with the invention, in order to obtain maximum grindability and, furthermore, the desired degree of fineness of the mill discharge, the pre-treated mixture of coarse and fine material fed to the mill is charged at a given ratio with respect to the properties of said material and the desired final product from the primary autogenous grinding mill.

When grinding a given mineral material, pre-crushed to a selected particle size and having a naturally formed particle-size distribution, of the grinding mill charge. A typical example of this is shown in FIGS. 1–2, which are size distribution graphs for mill charges to an autogenous grinding mill.

The graphs, each show a part which is characteristic of screening curves, namely the higher, steep part of the curve having a continuous distribution toward finer fractions, down to a given particle size, which in the illustrated case meet about a break point on the screening graph which can be defined as a point in the screening graph where two tangents drawn through the inflexion points lying nearest the break point of the screening graph meet, namely an inflexion point located on the right of the steeply rising part, and one located on the next horizontal left part of the screening curve shown in the graph. The points of inflexion are situated on each side of the so called "knee" on the size distribution graph, (P. H. Fahlström, 1974, Autogenous Grinding of Base Metal Ores at Boliden Aktiebolag, presented at the 75th Annual General Meeting of the CIM, Vancouver, April 1973). The point at which the tangents intersect represents a point which can be defined as the break point of impact for the grinding mill charge in question. Said break point is a term used in grinding techniques, and can also define the particle size of the material which breaks down by impact grinding i.e. the largest particles in the grinding mill charge that are rapidly broken down by impact to particles smaller than the more or less horizontal part of the screening curve. In FIG. 1 this refers to particles of not more than 30 mm in size which are broken down to particles of around 1 mm or finer. In the present invention the finer fraction is screened so that the $K_{95}$ for the fine fraction of the material entering the grinding mill does not exceed this break point. The material discharged from a primary autogenous grinding mill using this invention is well suited for final grinding in a secondary pebble mill, the grinding media of which can be taken, to advantage, from the primary grinding charge by means of pebble extraction described and illustrated in Swedish Patent Application No. 7909921-4. It will be understood, however, that a conventional ball mill can be used instead of a secondary pebble mill.

Figure 1:
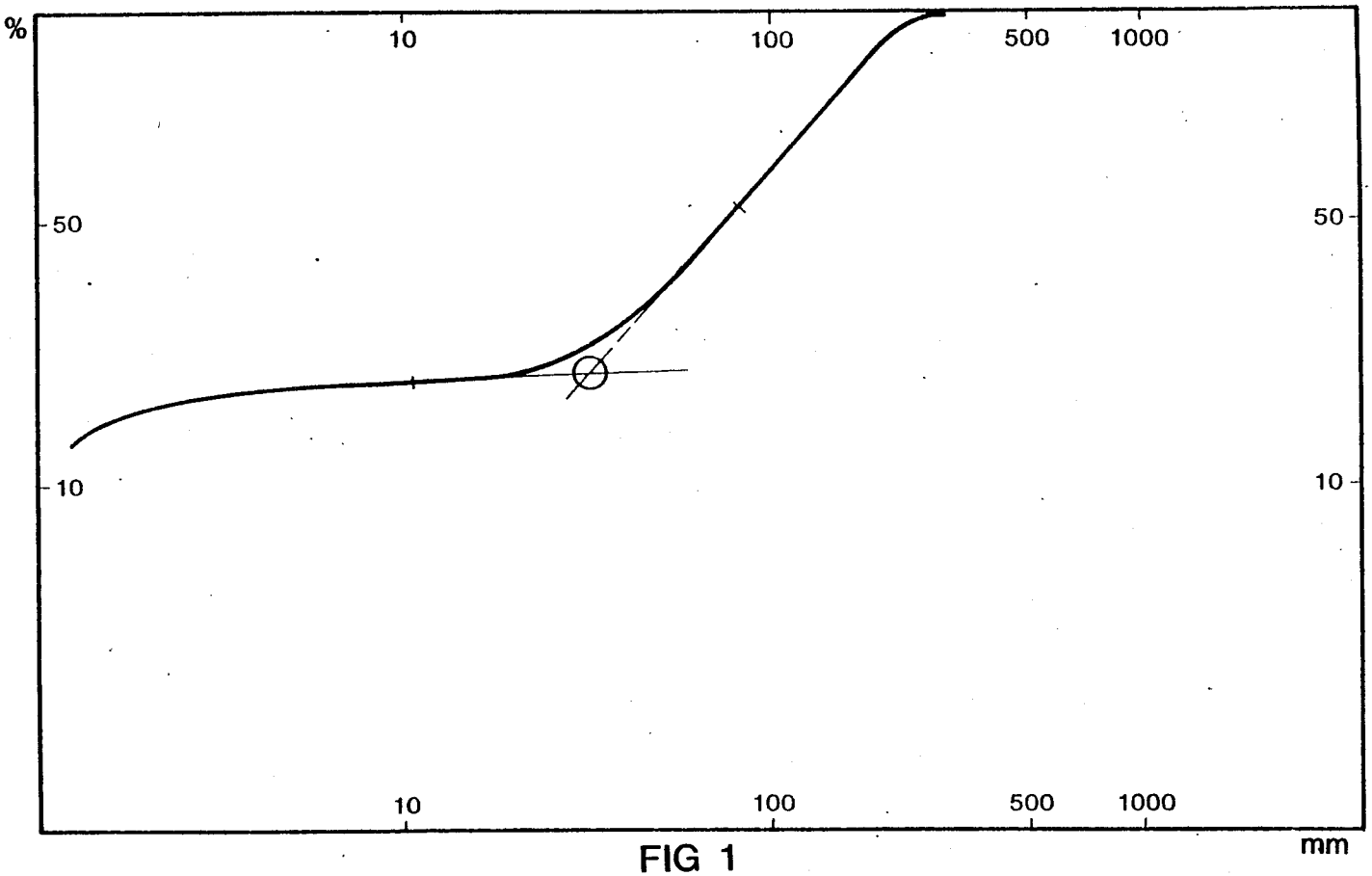
FIGS. 1–3 are size distribution graphs.
Figure 2:
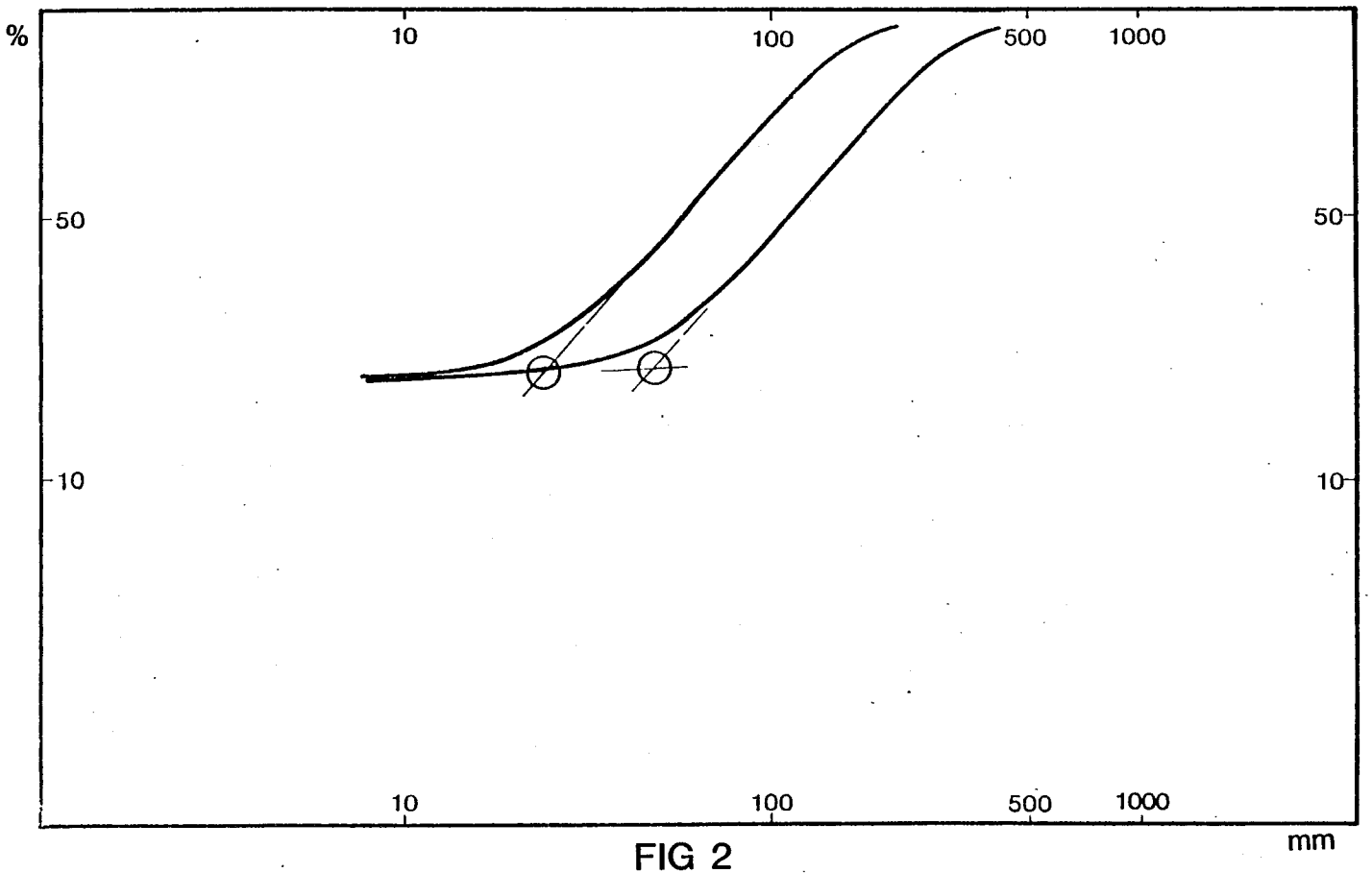
Figure 3:
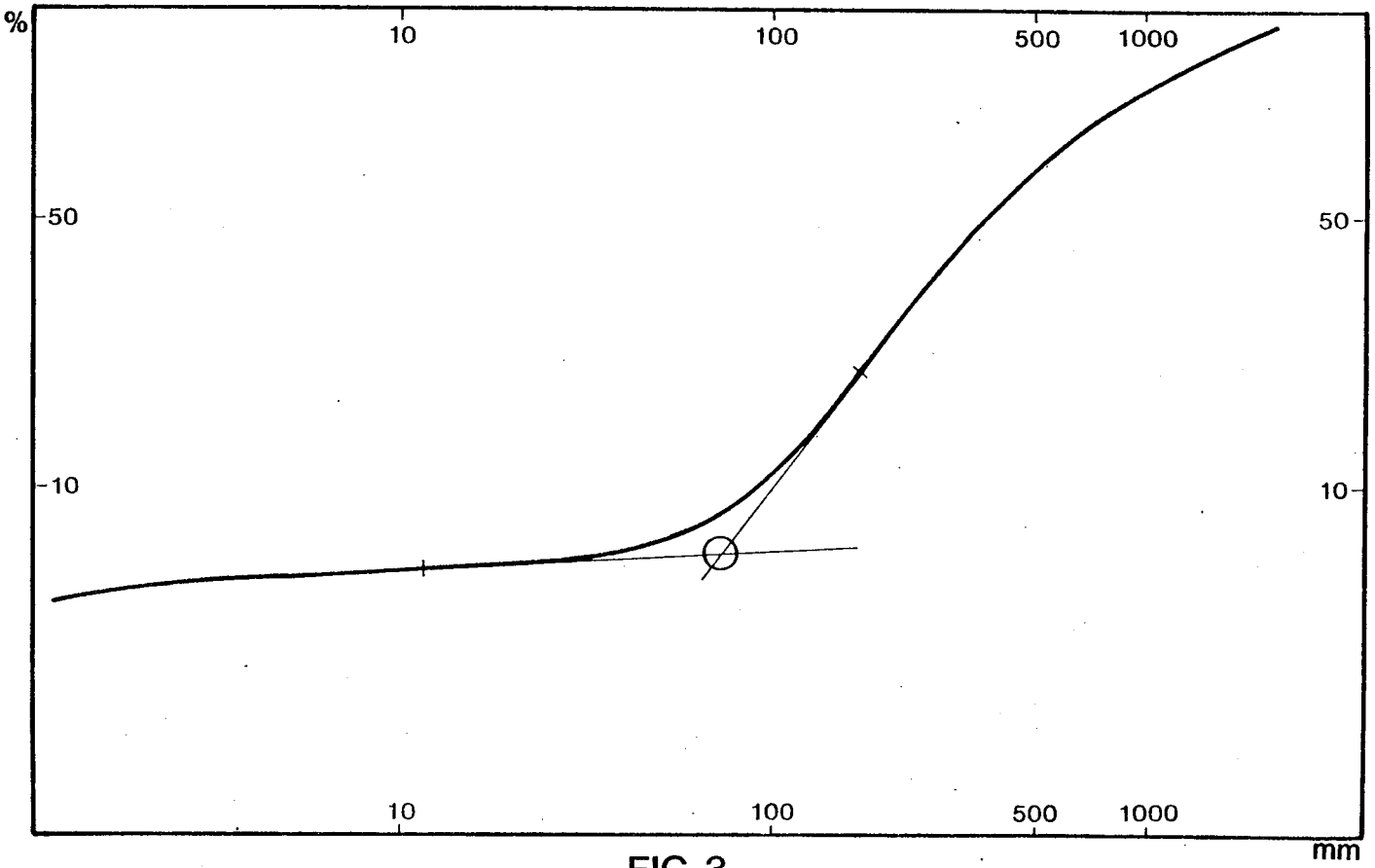

As will be seen from FIG. 1, the break point can be moved in parallel on the screening graph, when precrushing of the coarse material is displaced. FIG. 2 illustrates the case where the material has been precrushed to a $K_{95}$ particle size of about 150 and 300 mm respectively. In this case, the break point of impact, in respect of the same material, can be determined to $K_{95}$ about 25, and 50 mm respectively, depending on the degree of crushing for the coarse fraction.

In the method according to the invention, however, the location of the given break point is only critical upwardly. The fineness of the primary mill discharged can be controlled within wide limits, by proper selection of the parameters relating to the quantity and size of the coarse fraction relative to the fine fraction. In addition, an autogenous grinding circuit comprising at least two stages can be controlled in a manner to utilize the circuit optimally and to achieve an optimum cost situation, substantially independent of the grinding properties of the material, such as hardness, structure, homogenity. The smallest particle size of the coarse fraction exceeds at least the particle size represented by the upper one of said inflexion points. The smallest particle size of the coarse fraction is normally about 4–7 times the largest particle size of the fine fraction, while the lowest particle weight of the coarse fraction is 20–35 times the heaviest particle weight of the fine fraction. Thus, the method according to the invention will always provide a better over all economy than conventional autogenous grinding techniques, besides affording particular advantages in the case of materials which are extremely uneconomical or technically incompetent for use with conventional autogenous grinding techniques.

As a typical example of the potential of the invention, two ores were selected and tested on a pilot scale. The first is illustrated in Table 1, which shows the result obtained with a coarse-grain quartzite, which also exhibits extremely good properties for conventional autogenous grinding techniques. Table 2 shows the result obtained with a fine-grain complex tuffite, the properties of which render it unsuitable for autogenous grinding previously known.

TABLE 1

| | Conventional Autogenous Grinding | Technique according to the invention | Δ% |
|---|---|---|---|
| Feed rate, tph | 4.1 | 6.9 | +68% |
| Mill discharge % <44 microns | 29.0 | 21.4 | −26% |
| Energy, kWh/t | 9.6 | 5.4 | −44% |
| Grindability kg/kWh >44 microns | 26.1 | 33.1 | +27% |

TABLE 2

| | | | |
|---|---|---|---|
| Feed rate, tph | 1.60 | 3.46 | +116% |
| Mill discharge % <44 microns | 64.4 | 42.1 | −35% |
| Energy, kWh/t | 36.6 | 15.8 | −57% |
| Grindability kg/kWh <44 microns | 17.0 | 24.2 | +42% |

Thus, it will be seen from the Tables that, inter alia, the grinding effciency when grinding in accordance with the invention as compared with grinding using conventional autogenous grinding techniques is 27% better for a material according to Table 1 and 42% better for a material according to Table 2, and that the mill discharge contains far less material <44 microns, which shows that the primary milled product has contained the desired coarser fraction prior to the secondary grinding stage.

PREFERRED METHOD OF CARRYING OUT THE INVENTION

The invention will now be described in more detail with reference to the aforementioned drawings 1–3, and to a schematic flow diagram of a preferred method according to FIG. 4.

Figure 4:
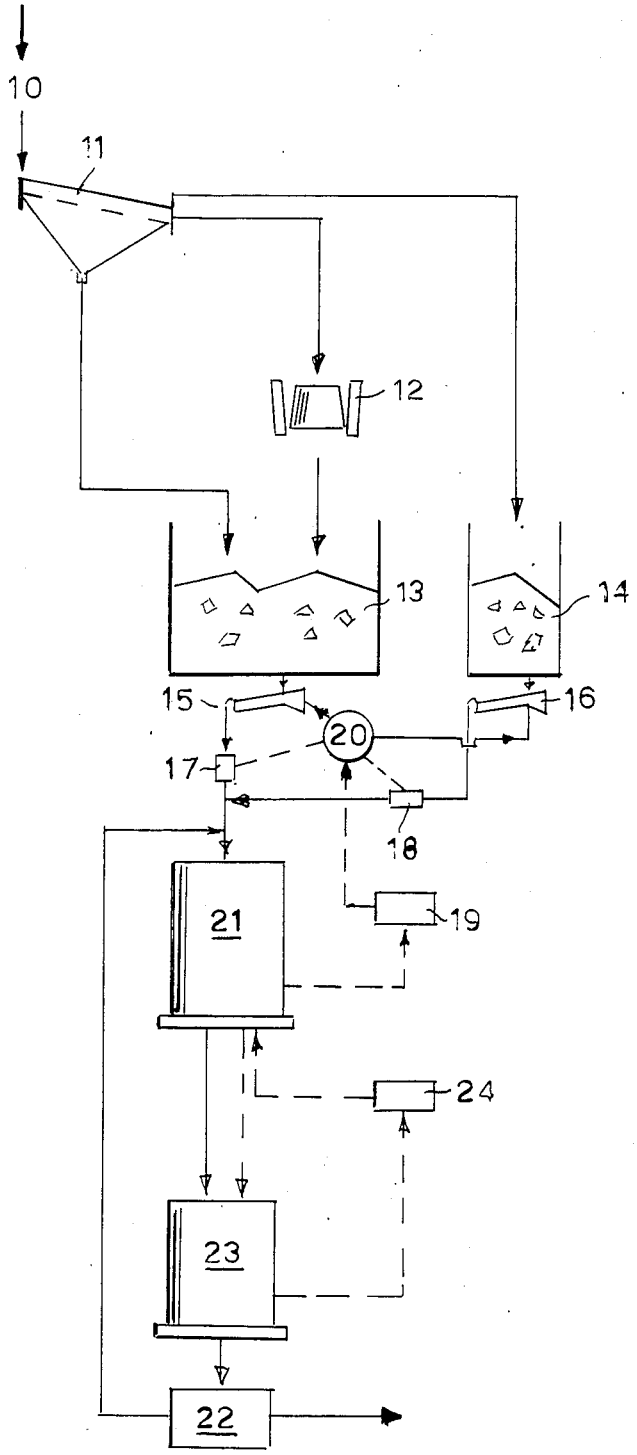
FIG. 4 is a schematic flow diagram of a preferred method of the invention.

The plant illustrated schematically in FIG. 4 comprises firstly means for pre-treating the material, including a crusher 10, a screening and crushing arrangement 11–12 and storage means for two separate fractions, a grinding plant comprising feeders 15, 16 which are programmed for control from a control unit 20, two belt weighers 17, 18, a primary and a secondary autogenous grinding mill 21, 22, a classifying(equipment) apparatus 23, and transducers 19 and 24.

The fragmented, large-lump material is crushed to a given fragment size in the crusher 10, whereafter the material is divided into three fractions on a screening apparatus 11. The coarsest of the three fractions is determinded by the predetermined coarsest fragment size from the crusher 10 and by an undersize determined, inter alia, by the fraction range suitable for each particular ore type. The intermediate fraction, is crushed in the crusher 12 to the same $K_{95}$ particle distribution as that of the fine fraction obtained from the screen 11, and the charge of coarse and fine materials, respectively to the mill 21 is effected in accordance with a separate programmed process model, from a microprocessor in the control unit 20, the input data for said processor being obtained from the belt weighers 17,18 and the transducer 19.

The energy input to the secondary-grinding process is regulated through the mill 22, the grinding mill charge of which is taken from the mill 21 with an automatically functioning grinding pebble extractor in accordance with Swedish Patent Application No. 7909921-4, and is dependent upon the properties of the material in question.

We claim:

1. In a process for comminuting ore containing a mixture of coarse particulate material together with the fine fractions which occur naturally upon crushing wherein the ore is comminuted in a primary grinding mill to form an intermediate product, and said intermediate product is further comminuted in a secondary grinding mill, and wherein said coarse particulate material is comminuted in said primary mill by autogenous grinding, the improvment comprising:

(A) fractionating said coarse particulate ore prior to comminution in the primary grinding mill into three fractions to recover a coarse particle size fraction, an intermediate particle size fraction and a fine particle size fraction wherein (i) said fine particle size fraction consists essentially of the portion of said coarse particulate material having a particle size not greater than the intersection of two tangents to the particle size distribution curve obtained by autogenous grinding of said coarse particulate material without fractionation, which particle size distribution curve is characterized by a first segment which is a downwardly sloping portion representing relatively coarser material and a second segment which is a nearly horizontal portion extending generally between the maximum particle size which will be broken up by impact and the particle size which results from said impact, there being in each of said segments a point of inflection, and said tangents are tangent to the particle size distribution curve at the points of inflection in said first and second segments of said curve, (ii) said coarse fraction consists essentially of the particles in said coarse particulate material of which the weight of the smallest particle in the coarse fraction is at least 20 times the weight of the heaviest particles in said fine fraction, and (iii) said intermediate particle size fraction consists essentially of the coarse particulate material not recovered as either fine or coarse fractions (B) comminuting the intermediate size fraction recovered from said fractionation step so that the coarsest particle size of the comminuted intermediate fraction is not greater than the coarsest particle of the fine particle size fraction; and (C) combining said comminuted intermediate fraction, said fine particle size fraction and said coarse particle size fraction as a feed to the primary autogenous grinding mill.

2. A method according to claim 1, characterized in that the smallest particle size of the coarse fraction has a weight which is about 20 times the weight of the largest particle size of the fine fraction.

3. A method according to claim 1, characterized in that the coarse fraction is $>10\%$ and the fine fraction is $<90\%$ of the feed to the primary grinding mill.

4. A method according to claim 3, characterized in that the coarse fraction is 10–25% and the fine fraction is 90–75% of the feed to the primary grinding mill.

5. The improvement according to claim 1 wherein the smallest particle size of said coarse fraction is at least about four times the largest particle size of said fine fraction.

6. The improvement according to claim 1 wherein the smallest particle size of said coarse fraction is at least about 7 times the largest particle size of said fine fraction.

* * * * *